United States Patent [19]

Kuhn et al.

[11] Patent Number: 4,891,017

[45] Date of Patent: Jan. 2, 1990

[54] SOCKET CONNECTOR WITH PIN ALIGNING HOUSING

[75] Inventors: Brent A. Kuhn, Winston-Salem; Garold M. Yurko, Greensboro, both of N.C.

[73] Assignee: AMP Incorporated, Harrisburg, Pa.

[21] Appl. No.: 186,514

[22] Filed: Apr. 26, 1988

[51] Int. Cl.[4] ..... H01R 13/432

[52] U.S. Cl. ..... 439/380; 439/746

[58] Field of Search ..... 439/380, 744, 745, 748, 439/746

[56] References Cited

U.S. PATENT DOCUMENTS

| | | | |
|---|---|---|---|
| 3,311,866 | 3/1967 | Williamson | 439/748 X |
| 3,368,185 | 2/1968 | Dell et al. | 339/217 |
| 3,414,871 | 12/1968 | Tuchel | 439/748 |
| 3,538,439 | 11/1970 | Bennett et al. | 439/748 X |
| 3,697,927 | 10/1972 | Kunkle et al. | 339/19 |
| 4,002,400 | 1/1977 | Evans | 439/748 |
| 4,200,350 | 4/1980 | Zimmerman, Jr. | 339/91 |
| 4,343,523 | 8/1982 | Cairns et al. | 339/59 |
| 4,346,959 | 8/1982 | Daugherty et al. | 339/217 |
| 4,435,035 | 3/1984 | Berry et al. | 339/99 |
| 4,443,048 | 4/1984 | Moist, Jr. | 339/63 |
| 4,544,220 | 10/1985 | Aiello et al. | 339/59 |
| 4,557,542 | 12/1985 | Coller et al. | 339/59 |
| 4,640,567 | 2/1987 | Lundergan et al. | 339/94 |

*Primary Examiner*—Eugene F. Desmond

*Attorney, Agent, or Firm*—Robert W. Pitts

[57] ABSTRACT

A socket connector having a plurality of socket contacts engagable with pin contacts is disclosed. The socket connector is specifically adapted for mating with an array of pins positioned in a prescribed relationship on the exterior of an electrical component such as a fan motor. Individual sockets are contained within passages extending between the mating end and the rearward end of the housing and at least one of the passages has a constricted pin entry portion adjacent the mating end to align a pin to avoid pin-socket stubbing during mating. A laterally extending opening defined by a side entry mold is used to define this constricted portion and to define an opposed contact retention surface.

16 Claims, 7 Drawing Sheets

SOCKET CONNECTOR WITH PIN ALIGNING HOUSING

BACKGROUND OF THE INVENTION

1. Field of the Invention

This invention relates to electrical connectors, especially electrical connectors having female socket members engagable with a pin insertable into the socket and more particularly socket connectors having a housing which permits alignment of the sockets during mating with an array of pins to prevent stubbing of the pins against the sockets.

2. Description of the Prior Art

Pin and socket connectors and pin and socket terminals provide a highly reliable and economic means of establishing multiple lead connections in computers, computer/peripheral equipment, business machines, appliances, vending machines and other commercial equipment due to their reliability and shock hazard protection features. Pin and socket terminals can be employed to deliver power to electrical components such as small electric motors. Indeed socket terminals can be employed for interconnection to an array of pins permanently mounted to an electrical component, such as a conventional electric motor in which the pins are located in an integral header housing on the exterior of the electric motor casing.

U.S. Pat. No. 4,544,220 discloses a pin and socket electrical connector employing socket terminals of the type suitable for use in delivering power to an electrical component. The pin and socket connector shown in U.S. Pat. No. 4,544,220 employs stamped and formed socket terminals and stamped and formed pin terminals. The stamped and formed socket terminals disclosed therein, however, are generally suitable for use with other types of pins including solid pins which may be employed to deliver power to an electrical component such as a small electric motor.

U.S. Pat. No. 4,640,567 discloses another pin and socket connector employing receptacle terminals having an outwardly deflectable lance which engages a shoulder on a wall of a housing cavity when the socket terminal is inserted within a housing. In the pin and socket connectors shown in that patent, the contact portion of the sockets which engages the pin is located within cylindrical towers of silos which completely encircle the socket. The mating ends of these socket terminals are fully accessible and a mating pin can engage or stub the outer end of such socket terminals upon mating. Some lateral movement of both the pins and the sockets is possible, however, thus rendering stubbing problem insignificant for a connector of this type. Furthermore, the dimensions of the pin and socket connectors depicted in that patent can be mutually controlled so that misalignment is not a problem.

Misalignment of pins mounted in a header of an electric motor, however, can result in problems when a separate connector is used to establish the interconnection. The assembly of pins, for example a ground pin and two power pins, to an electrical component, such as an electric motor, is part of the motor assembly and, therefore, the precise side-to-side spacing of the pins may not be sufficiently controlled to avoid the stubbing problem when a multi-contact electrical connector is used. Therefore, the instant invention includes a pin aligning portion of each passage in which the socket housings are positioned. The minimum diameter of this pin aligning portion is less than the outer diameter of the socket so that the ends of the sockets will be at least partially covered. When a suitable chamfer is used in this constricted pin aligning portion of each passage, the pins and the sockets are free to move during mating so that stubbing of the pins against the ends of the socket contacts can be easily avoided. This constricted portion of the instant invention is possible because the connector housing is constructed using a side entry mold which leaves an opening in the side of one or more passages in the housing. Thus, a contact retention shoulder can be defined at one end of this lateral opening and the constricted pin entry portion can be molded at the other end when a core pin is withdrawn at right angles to the movement of a mold piece in the side entry mold defining the lateral opening.

Although some electrical connectors represented by the following patents employ housing passages which are at least partially open along the side, none of these disclose a connector in which these open side passages are used to permit definition of a constricted pin entry portion in a one piece housing. U.S. Pat. No. 4,557,542 discloses an electrical connector in which a wedge bar is inserted into the front of the housing in which at least a portion of the wedge bar defines the contact lining entry of the connector. Note, however, that this connector employs a separate member which must be assembled after the terminals have been inserted into the housing. U.S. Pat. No. 4,343,523 similarly employs a spacer which can be inserted into the mating end of the connector. U.S. Pat. No. 4,346,959 discloses a pull to seat electrical connector in which each terminal receiving passage is open along one side to permit lateral insertion of a wire before the electrical terminal is pulled into the housing through the mating face. Note, however, that this connector does not employ pin aligning at the mating end of the connector.

U.S. Pat. No. 4,435,035 discloses a multi-position electrical connector in which a side entry molding process is employed to define openings in the side of the insulative connector housing communiccable with the cavities in which the terminals are received. These laterally extending openings are employed to provide a shoulder against which an outwardly deflectable lance engages after the contact is inserted into the housing. Note, however, that the pin aligning adjacent to the mating edge is not molded by the combined action of a side entry mold piece and a reciprocal core pin. The pin alignment portion of that housing is simply defined by two reciprocal core pins since the rear of the contact receiving passage shown in that patent is unobstructed.

SUMMARY OF THE INVENTION

An electrical connector for establishing an electrical connection to one or more pins is disclosed. The connector is especially useful in establishing an electrical connection to an array of pins in which the side-to-side spacing of the pins is such that stubbing between pins and sockets might occur when mating. The electrical connector includes at least one socket in position within a passage extending from a mating end towards a rearward end of a housing. Each socket is generally positioned within a first portion of the housing intermediate the ends of the housing with a contact portion of the socket extending through a second, larger portion of the passage. A retention member, such as an outwardly deflectable lance, engages a retention surface in the passage which, in the preferred embodiment of the invention, comprises a shoulder defined between the first portion and the larger second portion of the passage. A constricted pin alignment or pin entry portion is located at the mating end of the housing. This pin entry portion has an inner diameter which is less than the outer diameter of the respective socket and, therefore, less than the inner diameter of the first portion of the housing through which the socket is inserted. The constricted pin entry portion is formed during the molding of the insulative housing by the combined movement of the reciprocal core pins and a laterally moving or side entry mold piece which forms an opening in the side of the housing communicating with the respective passage. In the preferred embodiment of this connector, the length of this lateral opening is at least equal to the spacing between the locking surface defined at the end of the deflectable lance and the end of the contact section adjacent the mating end of the housing.

BRIEF DESCRIPTION OF THE DRAWINGS

FIG. 3 is a section view of a socket contact attached to a wire prior to insertion into a housing passage which does not have a constricted entry portion adjacent the mating end.

FIG. 8 is a section view taken along section lines 8—8 in FIG. 7.

FIG. 9 is a section view showing the orientation of the three socket contacts relative to the pins extending from a header prior to mating.

DETAILED DESCRIPTION OF THE PREFERRED EMBODIMENT

Figure 1:
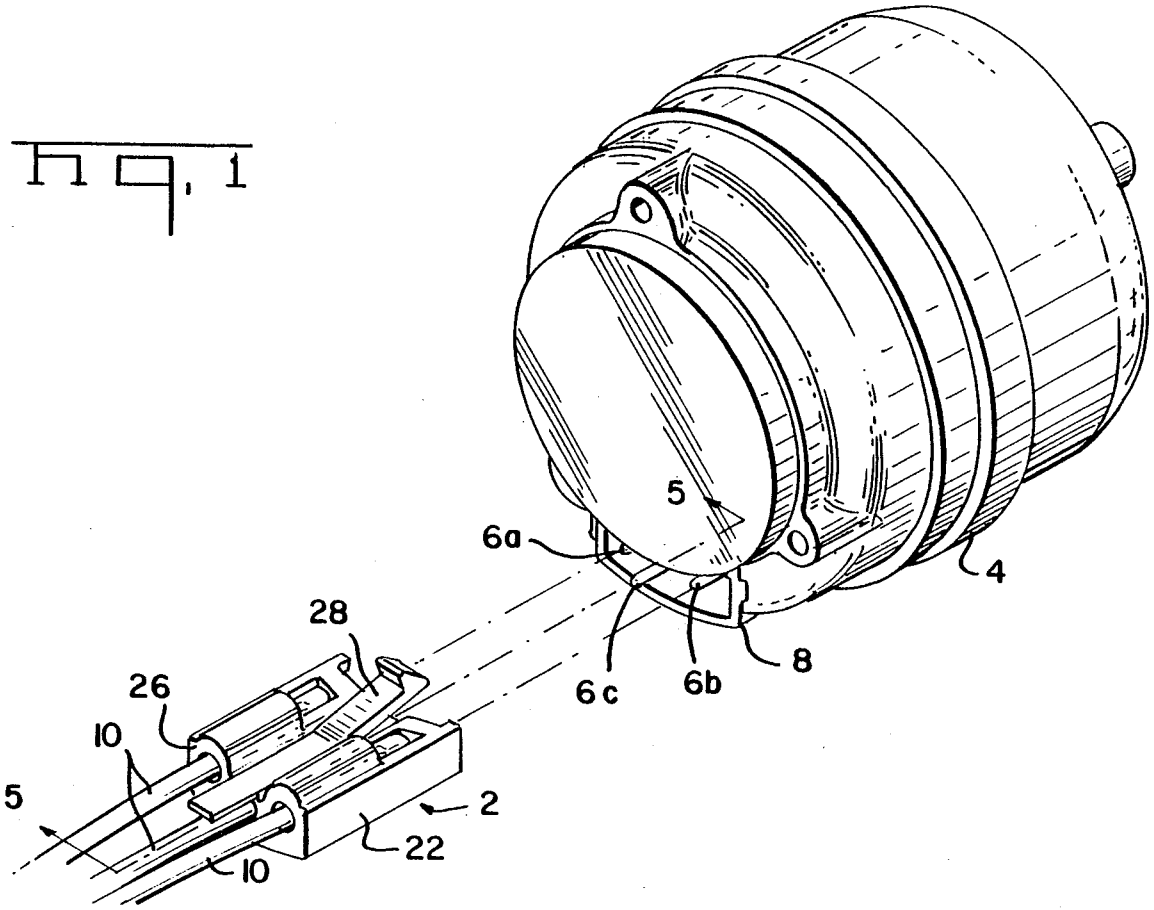
FIG. 1 is a perspective view showing an electrical connector comprising the preferred embodiment of this invention which is matable with an electrical component such as an electrical fan motor.
Figure 2:
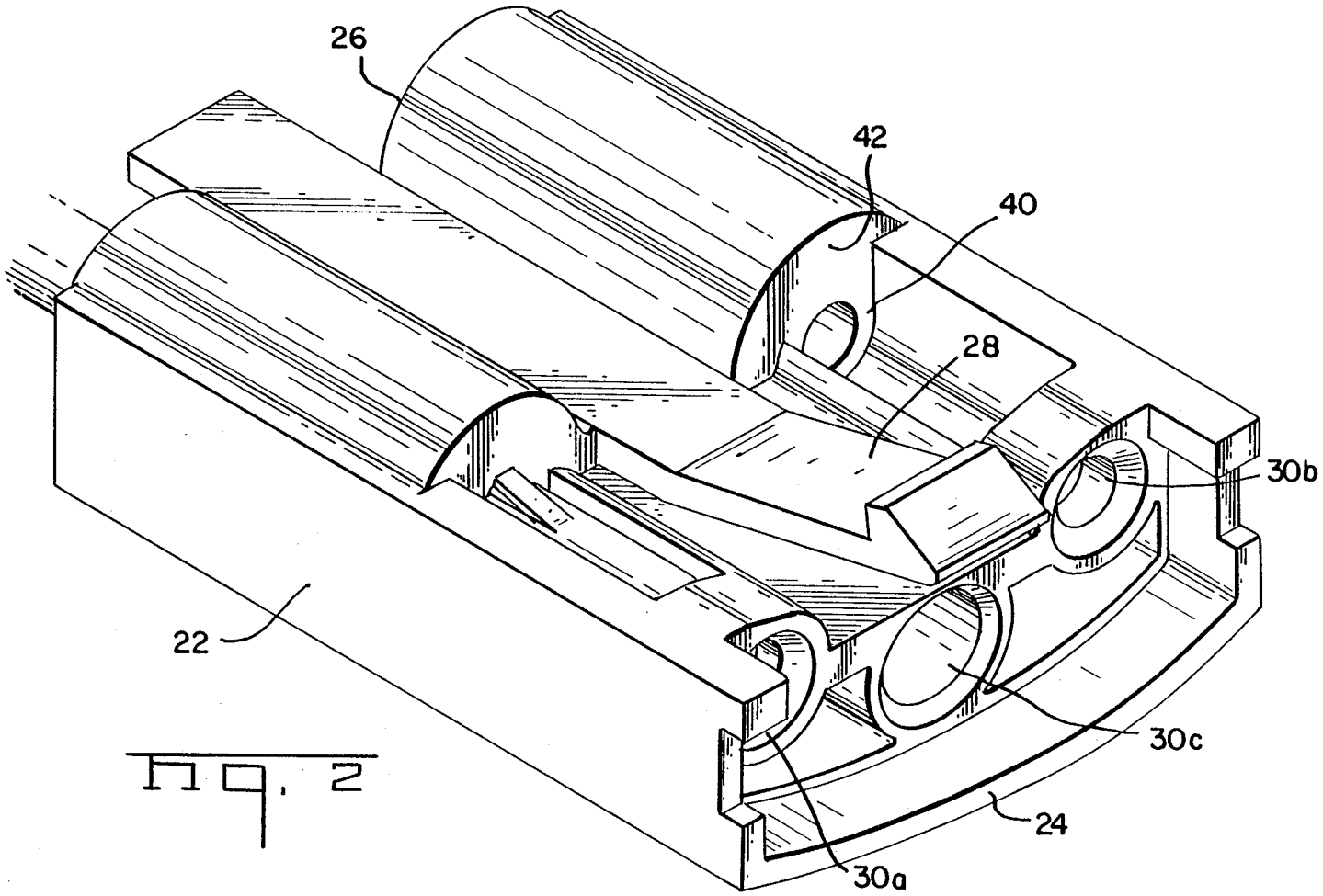
FIG. 2 is a perspective view of this connector showing the lateral openings communicating with at least two contact passages, with one contact located in one housing, the other passage being shown without a contact to better illustrate the construction of the housing.
Figure 7:
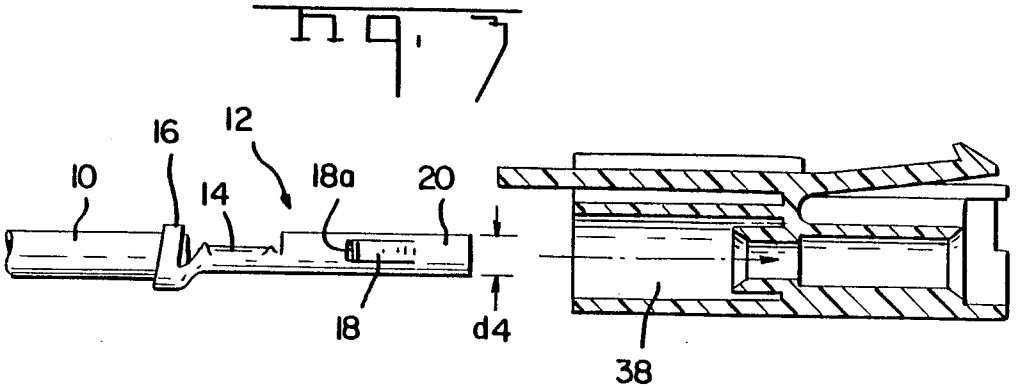
FIG. 7 is a section view showing the three cavities in the housing with a contact positioned in one cavity having a constricted pin entry portion.

The electrical connector or socket connector comprising the preferred embodiment of this invention is especially suitable for use in establishing an electrical connection to an array of pins 6 located on the exterior of an electrical component 4, such as a fan motor. The pins 6 are located within a pin header on the exterior of the casing of the electrical component 4. In the fan motor 4 shown in FIG. 1, three pins 6*a*, 6*b* and 6*c* are employed. Two pins, 6*a* and 6*b* serve as power contacts while a third pin 6*c* serves as a ground contact. The ground contact 6*c*in one embodiment of this fan motor 4 is longer than the power pins 6*a* and 6*b* so that the ground pin 6*c* will mate first. Pins 6 can comprise solid elongate members, stamped and formed members, or contacts formed of multiple solid sections. The header 8 comprises an insulative housing having a pin cavity dimensioned to receive the electrical connector 2. In the embodiment of the cylindrical fan motor depicted herein, the pin header has a generally arcuate cross-section, corresponding generally to the cylindrical cross section of the fan motor. It is understood, however, that the pin header 8 could have any configuration and that the side to side spacing of the array of pins 6 employed herein could differ from that shown in the illustrative embodiment.

The sockets 12 employed in the electrical connector 2 are of the type suited for electrical interconnection to pins 6. Pins 6 would thus comprise the first terminal, and the sockets 12 would comprise a matable second terminal. In the preferred embodiment of this invention, sockets 12, attached to wires 10, are stamped and formed members fabricated from a conventional resilient metal. Each socket contact has a wire crimp 14 and an insulation crimp 16 located at a rear end of the socket. This wire crimp 14 and insulation crimp 16 are applied to wires 10 in a conventional fashion. A cylindrical contact section 20 is resiliently expandable when a pin 6 is inserted therein to form an electrical connection and is located at the mating end of the socket 12. A pair of deflectable lances 18 are struck outwardly from the periphery of the contact section 20. These lances 18 comprise terminal retention means and each has a locking surface 18a consisting of its radially outermost end.

The sockets 12 are each positioned within passages 30 located within an insulating housing 22 formed of a conventional injection moldable material. The molded insulative housing 22 has a mating end 24 configured to seat within the cavity of the pin header 8 and a rearward end 26 through which wires 10 extend. Each of the passages 30 extends from the mating end 24 towards the rearward end 26. The housing 22 also includes a deflectable latch 28 comprising an integral portion of the housing which engages a companion surface in the pin header 8 to secure the electrical connector 2 to the component 4.

In the preferred embodiment of this invention, there are three passages 30*a*, 30*b* and 30*c* extending from the mating end 24 toward the rearward end 26 of the housing 22. The two outer passages 30*a* and 30*b* are adapted to receiving a shorter power contact pin 6*a* or 6*b* inserted through the mating end 24 when the connector 2 is mated with the pin header 8. The central passage 30*c* is adapted for receiving the longer ground pin 6*c* during mating. Each of the cylindrical passages 30*a*, 30*b* and 30*c* includes a first portion 32 intermediate the ends of the housing 22. This cylindrical first portion 32 has an inner diameter which is substantially equal to the outer diameter of the socket contact section 20. When a socket 12 is inserted into a respective passage, the socket contact section 20 is inserted through the first portion and the deflectable lance 18 is compressed during insertion. After complete insertion, the lance 18 is then free to expand to retain the socket 12 in the housing 22.

A second portion 34 of each passage is located djacent to first portion 32 and is larger than the first portion 32. In the central passage 30*c*, the central second portion 34' extends from the first portion 32 to the mating end 24 of the housing 22. Thus, the diameter of the second passage 30*c* at the mating end 24 is equal to the inner diameter of the second portion 34′ which is completely enclosed. The second portion 34 of the two passages 30*a* and 30*b* is unlike the central second portion 34′, open on one side. The opening 40 extends from the first portion 32 to a constricted third portion or pin entry portion 36 located at the mating end of the passages 30*a* and 30*b*. This constricted portion 36 has a pin entry chamfer 36 opening on the mating end 24 with the minimum inner diameter of the constriction portion 36 being spaced inwardly from the mating end 24. The minimum diameter of the constricted portion 36 is less than the outer diameter of the socket contact 20 so that the end of the socket contact 20 is at least partially covered by the constricted portion 36. The constricted portion 36, with the chamfer 36a, thus comprises means for guiding entry of a pin into engagement with a socket without permitting the pin to stub against the end of the contact section 20.

The opening 40, communicating with the second portion 34 of passages 30*a* and 30*b*, has a length substantially equal to the distance between the locking surface 18*a* on deflectable lance 18 and the constricted portion 36 of passages 30*a* and 30*b*. This opening 40 is wider than either the inner diameter of the first portion of each passage or the smaller inner diameter of the constricted portion 36. Thus, a shoulder or retention surface 42 is formed at the juncture between the opening 40 and the first portion 32 of passages 30*a* and 30*b*. Since the inner contour of the second portion 34 of passages 30*a* and 30*b* has a generally curved contour, opposite the opening 40, the shoulder or retention surface 42 extends completely around the first or contact retention portion 32 of passages 30*a* and 30*b*. Openings 40 are only formed in passages 30*a* and 30*b*. The deflectable latch 28 is located between openings 40 and is generally in line with the central passage 30*c*. The presence of deflectable latch 28 means that a side opening, similar to openings 40, cannot be formed in the same side. A similar opening could communicate with the central passaage 30*c* from the other side. Since the opening 40 is used to define the constricted portion 36 of the passages 30*a* and 30*b*, the central passage 30*c* does not have a constricted portion 36 at the mating end, and a ground pin inserted into this central pasage 30*c* will not be aligned in the same fashion as the power pins 6*a* and 6*b*.

Figure 10:
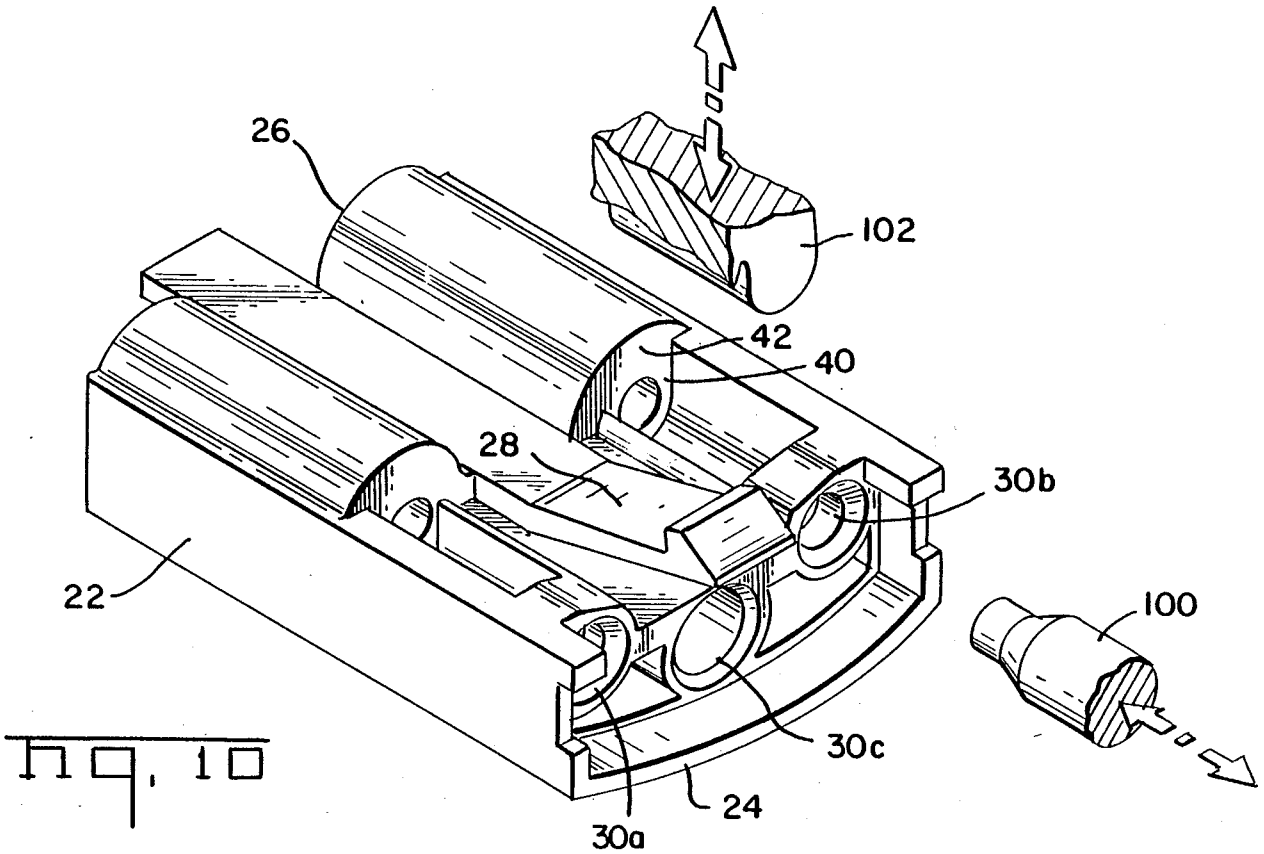
FIG. 10 is a perspective view showing the manner in which the reciprocal mold sections of a side entry mold are used to define the lateral passage openings and the constricted entry portion of the connector.

FIG. 10 shows the manner in which this opening 40 is defined by a side entry mold plate piece 102 which moves orthogonal relative to the reciprocal movement of a core pin 100. As shown in FIG. 10, core pin 100 and the side entry mold piece 102 are both used to define the constricted portion 36, having a minimum inner diameter less than the diameter of either the second portion 36 or the first portion 32. In other words, the core pin 100, defining the constricted portion 36, must be shiftable out of the mating end 24 of the housing. The side entry mold piece 102 also serves to define the retention surface 4 at the juncture between the second portion 34 and the first portion 32. By using a technique such as that shown herein, the inner diameter d1 of the first portion 32 can be less than the diameter or width d2 of the second portion 34 of the passage while the diameter d3 of the third or constricted portion of each passage 30*a* and 30*b* can be less than both the inner diameter d1 of the first portion 32 and the diameter or width d2 of the second portion 34. Thus, the inner diameter d1 of first portion 34 can be substantially equal to the outer diameter d4 of the contact section 20, and the inner diameter d3 of the constricted portion 36 can be less than the outer diameter d4 of the contact section 20.

Figure 4:
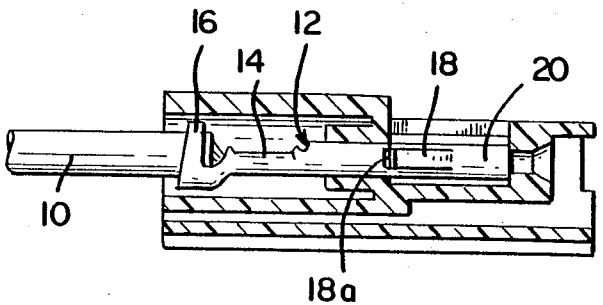
FIG. 4 is a section view showing a socket contact positioned within a housing passage having a constricted entry portion adjacent the mating end.
Figure 5:
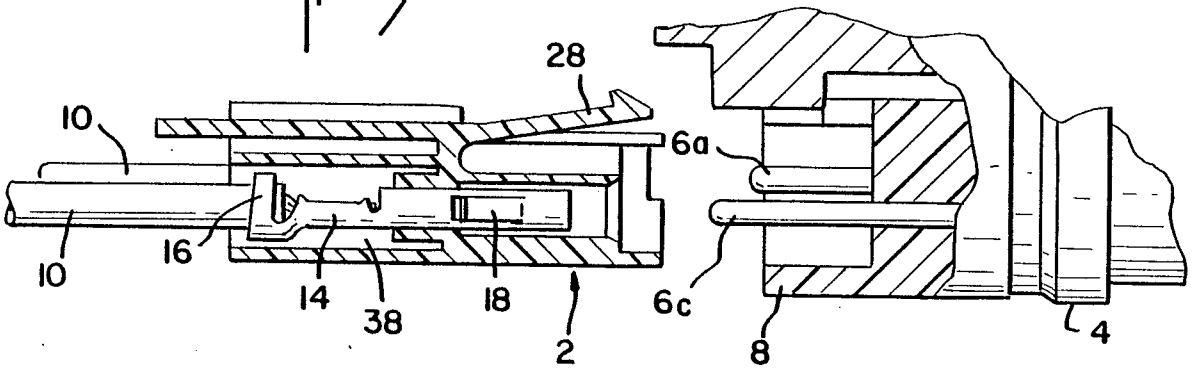
FIG. 5 is a side view showing the connector prior to mating with the electricacl component.
Figure 6:
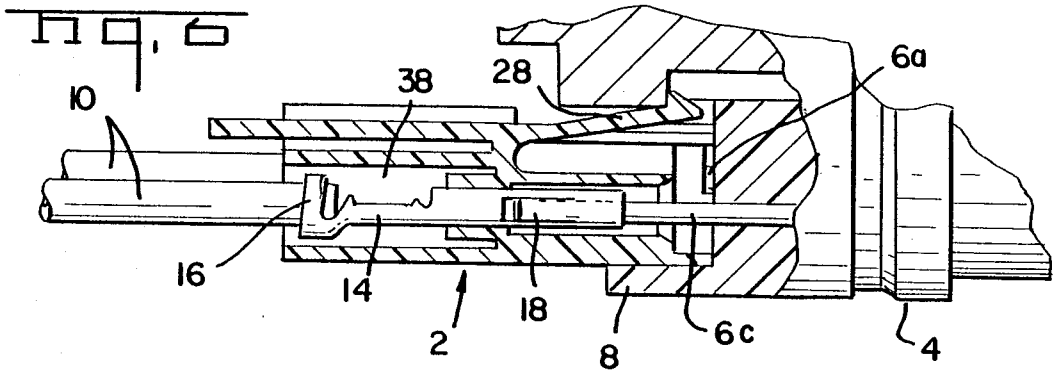
FIG. 6 is a view similar to FIG. 5 showing the connector mated to the pins in a header on an electrical component.
Figure 6:
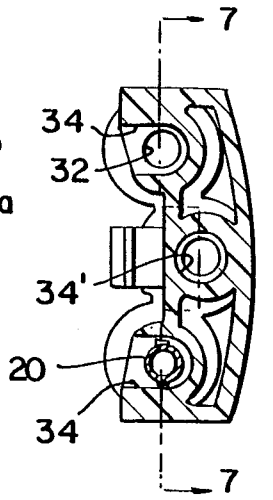
Figure 7:
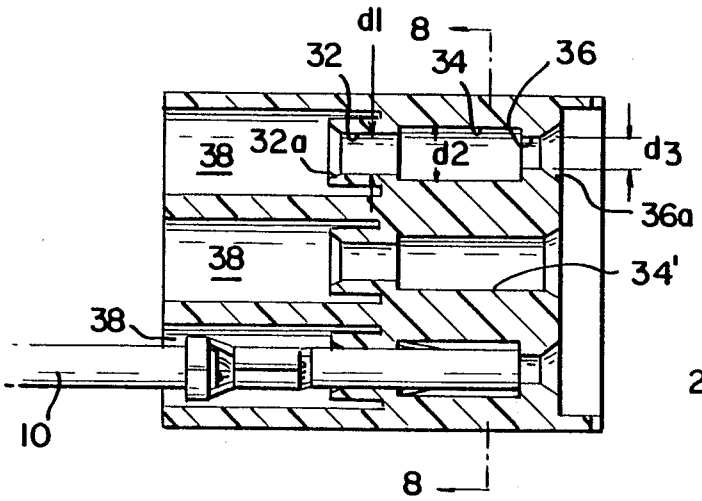
Figure 7:
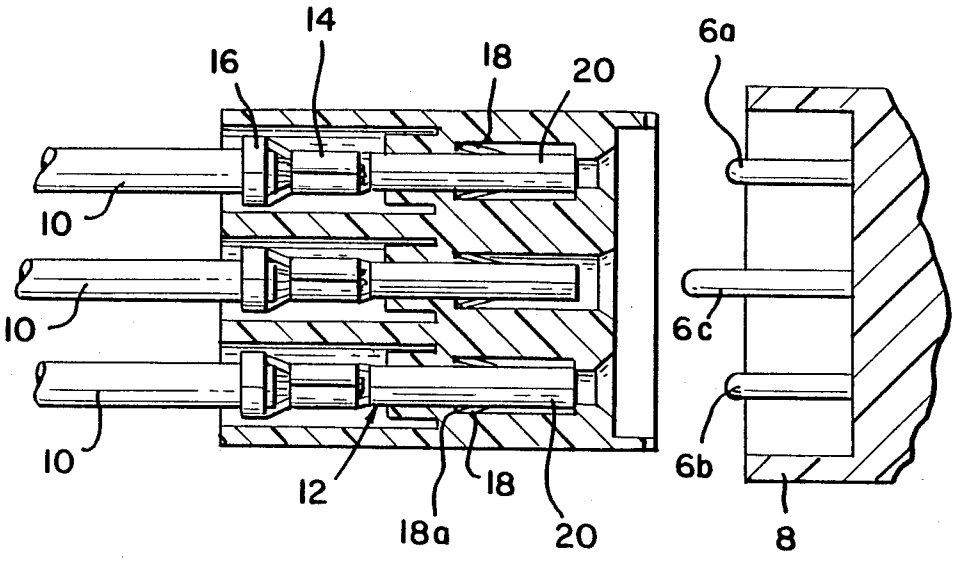

As shown in FIGS. 3 and 4, the individual socket contacts 12 are insertable into the passages 30 of the housing 22 through the rearwarad end 26. These sockets 12 are first insertable through a recess 38 formed between the rearward end 26 of the housing and the first portion 32 located intermediate the rearward end 26 and the mating 24. This recess has an inner diameter which is greater than the inner diameter of the first portion 32. In the preferred embodiment of this invention, individual recesses 38 are formed as the rearward part of each passage 30. Each recess 38 is dimensioned to receive the outer insulation crimp 16 of each socket 12. When the contact portion 20 of each socket is inserted through the first portion 32, a chamfered surface 32*a* at the rear of the first portion 32 serves to align the mating end of the contact section 20 to permit the socket to be inserted through the first portion 32. The deflectable lances 18 are inwardly deflected during passage through the first section 32 and these lances 18 snap outward so that the locking surface 18 engages the retention surface 42 facing the mating end located between the first portion 32 and the second portion 34. Each of the passages 30*a*, 30*b* and 30*c* has a first portion 32 and a retention shoulder 42 formed between the first and second portions.

When the sockets 12 are fully inserted into the housing passages 30, the sockets 12 in the two side passages 30*a* and 30*b* have the mating end covered at least in part by the constricted portion 36 which provides both wire entry and anti-stubbing protection. Although the mating end of the socket contact 12 located in the central passage 30*c* is exposed, this socket is intended to be mated with the longer ground pin 6*c*. When the electrical connector is mated to pin header 8, this longer central pin 6*c* can be easily aligned with the socket 12 because it is the first to mate with its corresponding socket. Thus, the entire connector 2 can shift laterally to permit mating with the longer ground pin 6*c* and the central socket 12 in central passage 30*c*. The two shorter pins 6*a* and 6*b*, however, will need to be precisely positioned relative to the sockets 12 and passages 30*a* and 30*b*. The stubbing problem caused by the relatively large tolerance in the positioning of pin 6*a*, 6*b* and 6*c* is much greater when an array of pins is inserted into a connector having a plurality of contacts that when a single pin is inserted. The preferred embodiment of this invention is intended to be used with a three pin array used for the electrical input to a component such as a fan motor 4. It should be understood, however, that this invention can be adapted to other configurations and would indeed be even more significant where a larger number of pins have been employed. Therefore, the following claims are not limited to the preferred embodiment depicted herein but to other embodiments readily apparent to one of ordinary skill in the art.

We claim:

1. An electrical connector for establishing an electrical interconnection to an array of pins comprising:

a plurality of sockets positioned within passages extending from a mating end toward a rearward end of an insulative housing;

each passage having a first portion intermediate the ends of the housing with a diameter substantially equal to the outer diameter of the socket and a second portion, adjacent the first portion, being larger than the first portion to form a shoulder therebetween facing the mating end;

each socket having deflectable lances engagable with the shoulder after insertion of the lances through the first portion;

at least a first passage having a third portion adjacent the mating end of the housing with a minimum inner diameter less than the outer diameter of the socket, the third portion comprising means for guiding entry of a pin into engagement with a socket in the first passage without stubbing the socket disposed therein, the second portion of the first passage having an opening on one side with a width greater than the inner diameter of the third portion of the first passage, the shoulder extending around the first portion peripherally beyond the opening, the opening being formed by a mold piece shiftable transversely to a core pin forming the third portion of the first passage when the insulative housing is molded.

2. The electrical connector of claim 1 wherein the third portion includes a chamfered surface opening onto the mating end.

3. The electrical connector of claim 1 wherein the second portion of the first passage has a curved contour opposite the opening.

4. The electrical connector of claim 1 wherein the opening extends from the first portion to the third portion of the first passage.

5. The electrical connector of claim 1 wherein a recess extends rearwardly from the first portion of the first passage and opens onto the rearward end of the housing, the recess being larger than the first portion.

6. The electrical connector of claim 1 wherein a second passage has a second portion which extends to the mating end of the housing.

7. The electrical connector of claim 1 wherein each socket comprises a stamped and formed member having a cylindrical contact section with at least one deflectable lance extending radially outward from the cylindrical contact section.

8. The electrical connector of claim 7 wherein the cylindrical contact section is located within the second portion of each passage.

9. An electrical connector for establishing an electrical interconnection to at least one first terminal comprising:

at least one second terminal matable with one first terminal, each second terminal being positionedd within a first passage in an insulative housing, each second terminal including a contact section;

terminal retention means on each second terminal, the terminal retention means having a locking portion engagable with a locking surface on the housing;

a constricted portion of the first passage adjacent one end of the housing, the constricted portion having minimum diameter less than the outer diameter of the contact section of the second terminal; and an opening, on one side of the first passage, having a width greater than the minimum diameter of the constricted portion and a length at least equal to the distance between the locking portion and an end of the contact section adjacent the constricted portion, the locking surface extending around the first passage peripherally beyond the opening.

10. The electrical connector of claim 9 wherein the retention surface comprises one end of the opening.

11. The electrical connector of claim 9 wherein the terminal retention means comprises a lance extending radially outward from the contact section.

12. The electrical connector of claim 11 wherein the locking portion comprises the outer end of the deflectable lance.

13. The electrical connector of claim 12 wherein the contact section comprises a cylindrical socket.

14. A socket connector for establishing an electrical interconnection to an array of pins on an electrical component, the pins being located side-by-side, at least one of the pins being longer than the remainder of the pins, the electrical connector comprising:

a plurality of like sockets, each socket being resiliently expandable when a corresponding pin is inserted therein to form an electrical connection with the corresponding pin, each socket having at least one deflectable lance extending radially outward from the periphery of the socket;

an insulative housing having a plurality of passages, each having one socket therein, each passage extending from a mating end toward a rearward end, the passages being oriented so that one pin can be inserted into each passage through the mating end, each passage having a first portion with a diameter substantially equal to the outer diameter of the socket and a second portion, adjacent the first portion, being larger than the first portion to form a shoulder therebetween facing the mating end;

at least each first passage receiving a shorter pin having a third portion adjacent the mating end of the housing with a minimum inner diameter less than the outer diameter of the socket, the third portion comprising means for guiding entry of a shorter pin into engagement with a socket in the first passage without stubbing the socket disposed therein, the second portion of the first passage having an opening on one side with a width greater than the inner diameter of the third portion of the first passage, the shoulder extending around the first portion peripherally beyond the opening, the opening being formed by a mold piece shiftable transversely to a core pin forming the third portion of the first passage when the insulative housing is molded.

15. The socket connector of claim 14 wherein the housing includes a deflectable latch adjacent the passage receiving the longer pin.

16. The socket connector of claim 15 wherein each cavity receiving a shorter pin has an opening extending through the housing on the same side as the deflectable latch.

* * * * *